US007802870B2

(12) United States Patent
Gipson

(10) Patent No.: US 7,802,870 B2
(45) Date of Patent: Sep. 28, 2010

(54) SCALABLE EXPANDABLE ROTOJET ROTATING SPRAY JET PRINTHEAD

(76) Inventor: Dwain Gipson, 1615 Shangri-La Dr., Reno, NV (US) 89509

( * ) Notice: Subject to any disclaimer, the term of this patent is extended or adjusted under 35 U.S.C. 154(b) by 436 days.

(21) Appl. No.: 12/009,024

(22) Filed: Jan. 17, 2008

(65) Prior Publication Data

US 2009/0185002 A1 Jul. 23, 2009

(51) Int. Cl.

| | |
|---|---|
| ***B41J 2/14*** | (2006.01) |
| ***B41J 2/16*** | (2006.01) |
| ***B41J 29/38*** | (2006.01) |
| ***B41J 2/015*** | (2006.01) |

(52) U.S. Cl. ..... 347/53; 347/9; 347/20

(58) Field of Classification Search ..... 347/53, 347/44

See application file for complete search history.

(56) References Cited

U.S. PATENT DOCUMENTS

| | | | |
|---|---|---|---|
| 4,553,870 | A | 11/1985 | Takenoya et al. |
| 5,760,817 | A | 6/1998 | Foote et al. |
| 5,801,744 | A | 9/1998 | Taniguchi et al. |
| 6,109,715 | A | 8/2000 | Masaki |
| 6,149,257 | A | 11/2000 | Yanaka et al. |
| 6,561,642 | B2 | 5/2003 | Gonzalez |
| 7,073,902 | B2 | 7/2006 | Codos et al. |

*Primary Examiner*—Matthew Luu
*Assistant Examiner*—Lisa M Solomon
(74) *Attorney, Agent, or Firm*—Kirk A. Buhler; Buhler & Associates

(57) ABSTRACT

A scalable expandable spray ink printer machine for use with paper roll stock is disclosed. A series of three or four print heads are place serially in proximity to paper stock. The configuration of the cylindrical print head allows the heads to be expanded for printing on wider paper stock. The print heads include a combination of fixed, turning and sliding components to align or block ink flow from the print ink reservoir. The printer is in fixed position perpendicular to the travel direction and rotates internally on an axis parallel to the paper or media to be printed. The print head is sectional and lengthwise expandable in fixed unit lengths. The printing machine is ideally suited for advertising or other elongated print media. Due to the use of standard paper, roll stock and speed of the printing, signs can be printed on demand and displayed in real-time.

20 Claims, 7 Drawing Sheets

SCALABLE EXPANDABLE ROTOJET ROTATING SPRAY JET PRINTHEAD

FIELD OF THE INVENTION

This invention relates to a printer that prints on paper roll stock. More particularly, the present invention relates to scalable expandable cylindrical print heads with multiple spray jets. A series of three or four print heads are place serially in proximity to paper stock. The configuration of the cylindrical print head allows the number of heads to be expanded for printing on wider paper stock. The print heads include a combination of fixed, turning and sliding components to align or block ink flow from the print ink well.

BACKGROUND OF THE INVENTION

Printers or printing machines today are available in a variety of configurations. The most common printers today utilize ink jet technology where ink is sprayed onto paper from a print head. Most printers that use this technology hold the paper in a fixed position and move the head side to side to spray dots of colored ink onto a paper. An exemplary example of this type of technology can be found in U.S. Pat. No. 6,109,715 issued to Masaki on Aug. 29, 2000. While this method of printing allows for printing on paper, it is limited to the preset width of the printer, and in most cases prints on just one page at a time. These printers are not expandable and cannot print fast enough to print a banner that can be viewed as a moving sign.

Most ink jet printing is based upon using a print head that is mounted to a horizontal carriage that carries it laterally across the paper or media to be printed. This device is in fixed position perpendicular to the travel direction and rotates on an axis that is parallel to the paper or media to be printed.

Another variety of printer is an impact printer. The impact printer prints with hammers, pins, or characters that strike a ribbon of ink to imprint the image onto the paper. These printers print either a complete horizontal line, vertical line or individual character using a daisy wheel. With these printing methods, the paper or print head is moved and ink is applied through a ribbon coated with ink. An exemplary example of this type of technology can be found in U.S. Pat. No. 4,553,870 issued to Takenoya et al on Nov. 19, 1985. While this printer is capable of impact printing color onto paper, the print head moves across the page in this configuration and the ink cartridge moves with the print head. This configuration is limited to the finite size of the printer arrangement to determine the size of the paper that can be printed upon, and does not allow for expansion of the paper width.

Another variety of printer is a thermal printer that uses special paper that is sensitive to heat. When an area of the paper is heating with a print head, the area turns dark. A patent that shows this type of printing technology can be found in U.S. Pat. No. 5,801,744 issued Sep. 1, 1998 to Taniguchi et al. This printer is capable of thermal printing onto paper, but the print head moves across the page in this configuration. It also requires special paper that may not be available in wide rolls. This configuration is limited to the finite size of the printer arrangement to determine the size of the paper that can be printed upon and does not allow for expansion of the print width.

Another variety of printer is a laser printer that uses a laser or similar methods to electrostatically charge particles of ink that are placed on the drum. As paper is brought in contact with the drum, the particles of ink are transferred to the paper and baked onto the paper. U.S. Pat. No. 5,760,817 issued to Foote et al. on Jun. 2, 1998 describe this type of printing method. This printer can use standard paper, but requires sophisticated technology that is sensitive to damage. The laser printer further is not expandable to print on wider media.

Traditional printing methods involve screening the image onto the paper or pressing the image onto the paper with a printing press. This type of printing method is most commonly used to print in large volumes of the same image. While these printing methods allow for a large amount of printing to be performed in a short period of time, it does not allow for quick and easy changing of what is printed, and may be limited to the finite length of printing.

A number of ink jet or spray printers are used for printing an image onto fabric. Typically, these printers include multiple print heads that move across the fabric to print the image. Examples of this printing method and machines are found in U.S. Pat. No. 6,149,257 issued on Nov. 21, 2001 to Toshiyuki Yanaka et al., U.S. Pat. No. 6,561,642 issued May 13, 2003 to Charlene Gonzalez and U.S. Pat. No. 7,073,902 issued Jul. 11, 2006 to Richard N. Codos et al. All of these printers operate with wide media, but offer a fixed length print head. The proposed design can be easily expanded to different lengths to accommodate print media of different widths.

What is needed is a simple to expand printer that can operate at a high print rate and can print on continuous sheets of paper. The ideal printer would use a cylindrical print head with drivers located outside of the cylindrical print head to collect and deposit ink onto a roll of paper. The ideal printer would also be able to print on both sides of the paper simultaneously as the paper is being fed through the printer. The proposed device satisfies these needs.

BRIEF SUMMARY OF THE INVENTION

It is an object of the present Rotojet printer is to provide an expandable printer for use with roll paper stock. The expansion capability allows for the printing heads, inkwells and platen to be stackable. The print head is sectional and lengthwise expandable in fixed 1.0" unit lengths. The units may be stacked into print head arrays of 6", 9" or other desired lengths. In order to accommodate 36" wide paper, an array of 36 print heads can be stacked. If at some point in the future 48" or 60" wide paper is used, additional units can be added to an existing printer to print on the wider paper.

It is another object of the Rotojet printer to provide a printer with marking heads spaced monotonically in an X-Y pattern around a ring or cylinder. When the cylindrical marking head is rotated and the marking heads print onto the print media passed under the marking heads, the visual interpretation of this arrangement produces an image. This image represents textual and or graphical data.

It is another object of the Rotojet printer to allow the printer to print on both sides of the paper at the same time. This can be done by placing printers on each side of the paper and connecting them through one or more controllers.

It is another object of the Rotojet printer to provide printing in colors. The printer can be changed from one to multiple colors by simply adding additional print heads to the printer. Because the print heads are a configurable part of the printer they can be easily added, changed or upgraded based upon the requirements of the end user.

It is a further objective of the Rotojet printer to provide a cost effective continuous printing method that can print long sheets of roll stock for advertising at businesses, sporting events or other locations that may want to promote or advertise. The advantage of this type of advertising message signs is that once the printer has printed the printer turns off and no additional power is used to display the information. The printed sign will display the message without consuming any additional power.

It is yet another object of the Rotojet printer to allow operation with a standard computer interface such as a serial, USB, internet, firewire, RS232, Ethernet or parallel printer port. The computer can be connected to the printer, the sign printed, and the computer disconnected leaving the sign being shown. Because of the cost effective nature of the printer and the operation of the printer, a different sign or advertisement can be printed and displayed every day, or printed on a continuous basis to appear as a scrolling message sign. The interface allows for printing of both text and or graphics as communicated from an attached computer. Internal memory can be included with the printer to allow the printer to automatically turn on at predetermined time or interval, print a sign and turn off again until the next interval.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
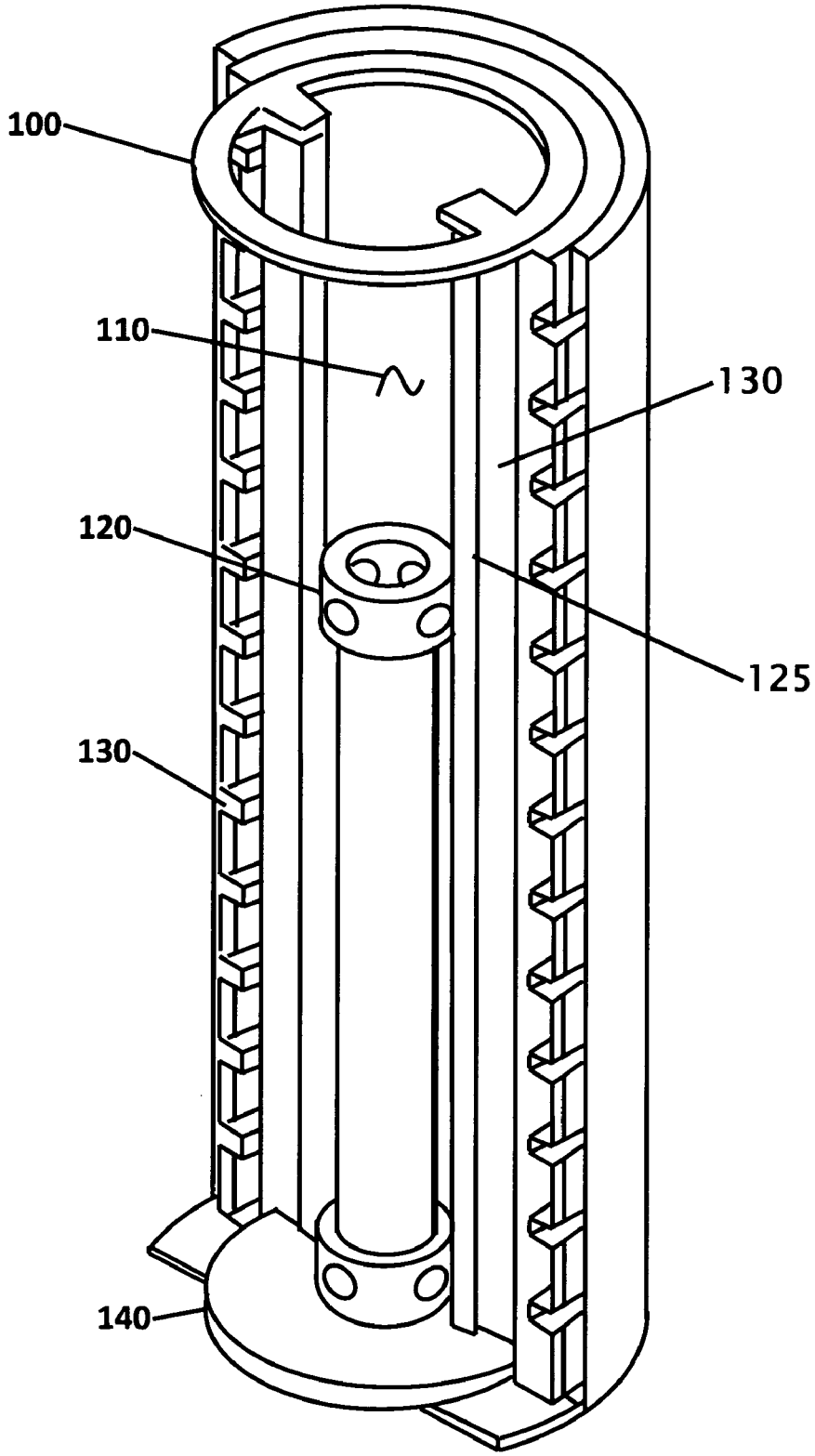
FIG. 1 shows an isometric sectional cut away view of the print head in a first embodiment showing the components.
Figure 2:
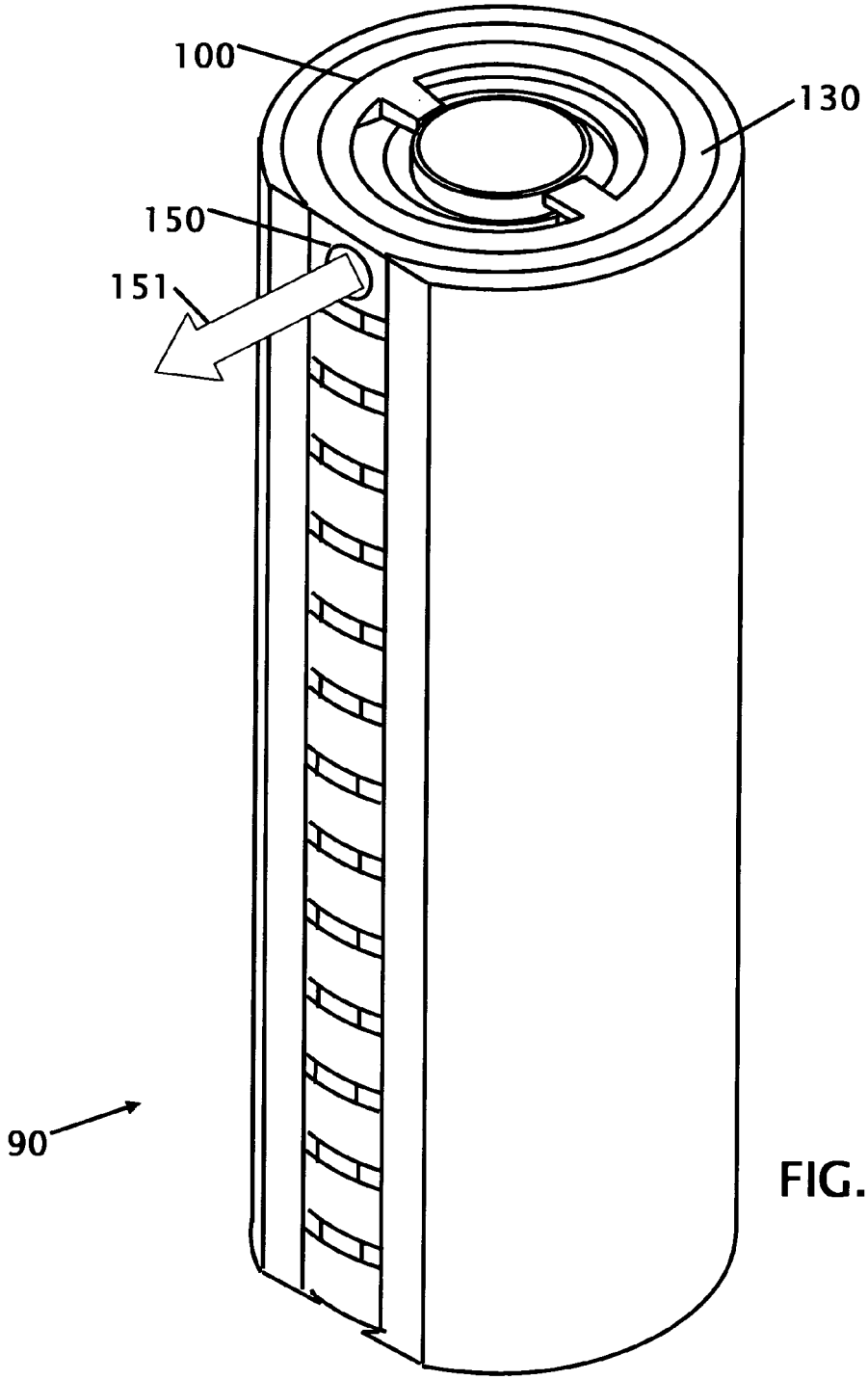
FIG. 2 shows an isometric view of the print head sub assembly in the first embodiment.

FIG. 1 is a sectional view of the print head and FIG. 2 is an exterior view of a print head sub assembly. The ink 110 is pressurized and normally flows thru the center of the print head. The ink 110 is selectively allowed to exit 151 through one of the spray nozzle 150. Because the paper or other printable media is traveling tangent to and parallel to the center axis of the print head, one full rotation causes all 14 of the spray nozzles to sequentially scan the paper in a line equal to the length of the print head. In this case, the print head 90 is 1-inch long and there are 14 spray nozzles along its length, so the print density is 14 dots-per-inch.

The non-rotating stator 120 is preferably made from a ferrous alloy and has a coil wrapped around it. It is located at the bottom and it shares the same centerline as all other components of the print head. The non-rotating slide port gate 135 has ferrous components molded into it and is configured as an armature for the stator 120. The rotating coupling spring 100 at the top of the print head assembly retains the slide port gate 135 at rest. At rest, the slide port gate 135 is vertically mounted as to normally block the path of ink through the rotating spray nozzles and rotating port gates in the gate ring 125. When the coil is energized, its magnetic force attracts the slide port gate 135 to the stator 120 flange 140. This action aligns the port in the slide port gate 135 with the ports in the rotating spray nozzle ring 130 and rotating port gate ring 125. This creates a path to the ink 110 and results in the ink exiting 151 through the spray nozzle 150 and onto the paper in front of it. The printer control circuitry selectively energized the stator coil to produce the desired dot pattern needed for image generation.

The print head is fashioned to be expandable. The basic 1-inch long print head is constructed to mechanically interlock end-to-end with another 1-inch print head. In this manner, a print head assembly if virtually any desired length could be constructed. In use, the length of the print head assembly has no impact on the lateral printing speed. Since the print head is designed to allow ink 110 to flow through its center, the length of the assembly does not have a great impact on the ink delivery system.

Figure 3:
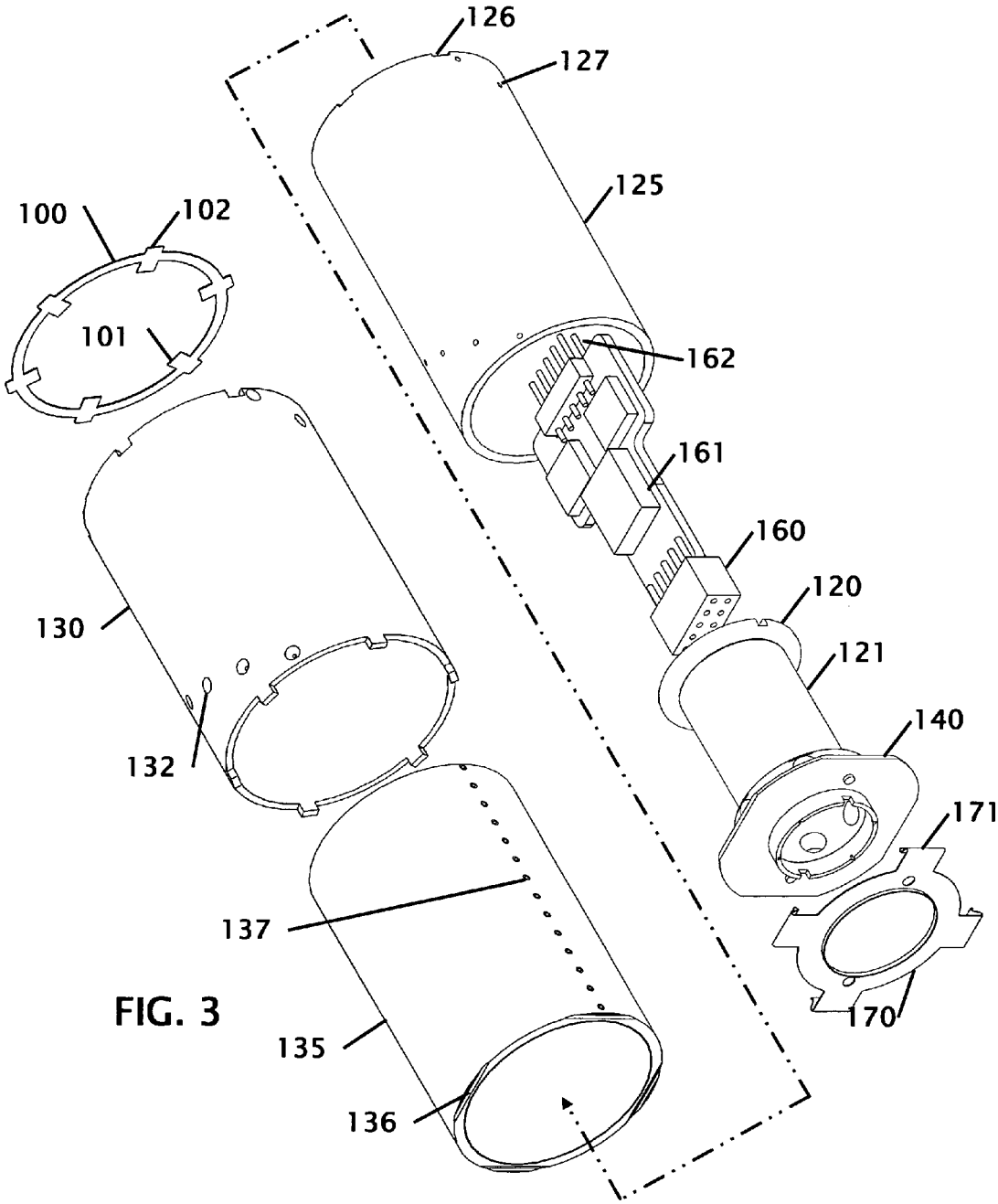
FIG. 3 is an assembly view of a preferred embodiment of the print head sub assembly.
Figure 4:
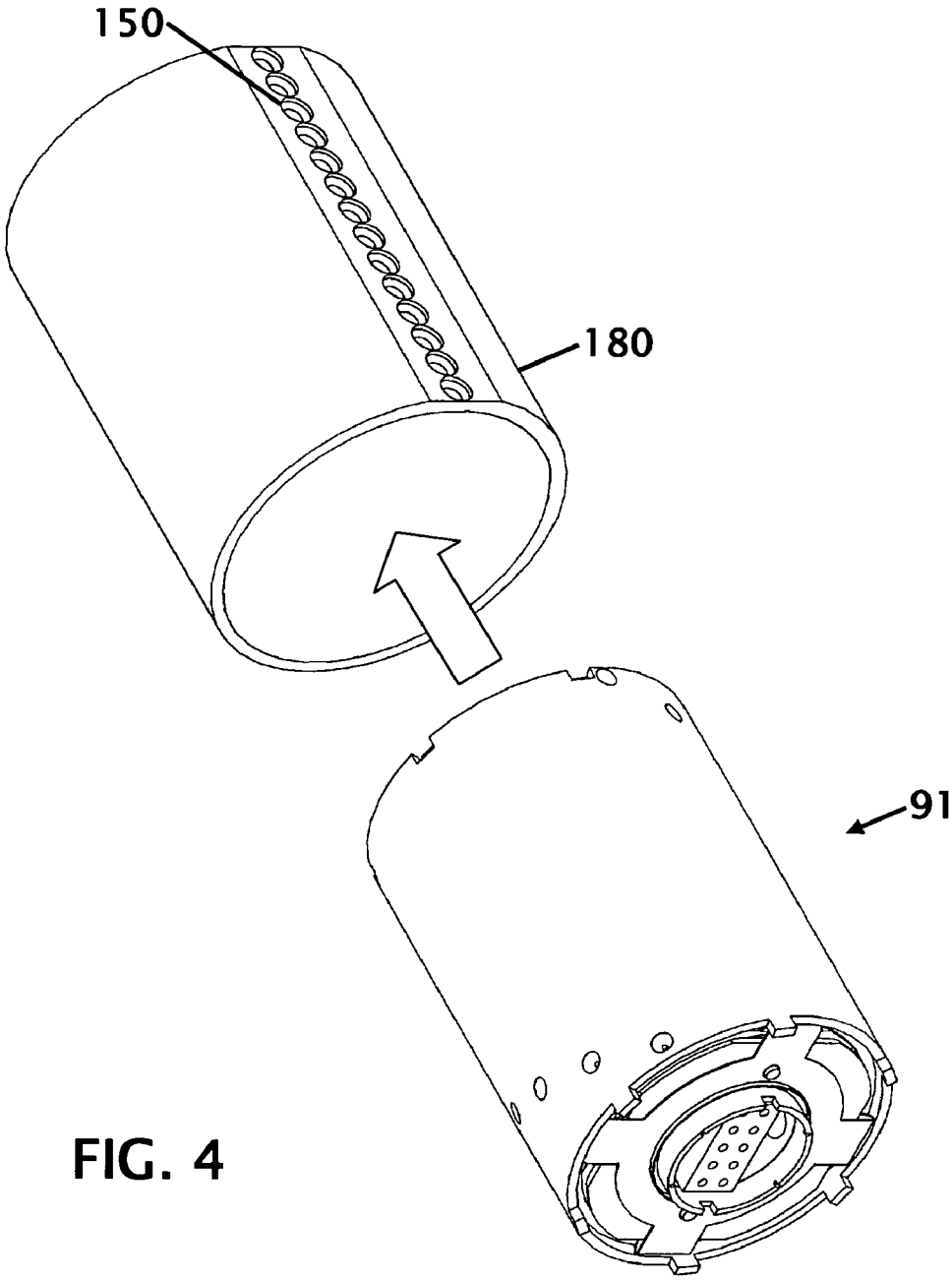
FIG. 4 is an assembly view of the preferred embodiment of the print head sub assembly from FIG. 3 being placed in the print head housing.

FIG. 3 is an assembly view of a preferred embodiment of the print head sub assembly and FIG. 4 is an assembly view of the preferred embodiment of the print head sub assembly from FIG. 3 being placed in the print head housing. The circuit board 161 contains the communication and driver to selectively energize the electromagnetic coil 121. The circuit board 161 includes male connector 162 and female connector 160 located on opposing ends to daisy chain with additional printing heads.

When the electromagnet 121 is energized, the slide port gate 135 is attracted to the lip 140 of the non-rotating stator 120. When the electromagnetic 121 is not energized, the slide spring 170 pushes the slide port gate 135 up. The gate ring 125 is assembled over the non-rotating stator 120 and the circuit board 161. The gate ring 125 is mechanically linked to the nozzle ring 130 with the rotating coupling ring 100. The rotating coupling ring 100 has teeth 101 to engage into the nozzle ring 130 at 131, and teeth 102 to engage into the gate ring at 126. A series of holes 127 in the gate ring 125 and a series of holes 132 in the nozzle ring 130 are maintained in alignment with the rotating coupling ring 100. The gate ring 125 and the nozzle ring 130 rotate in unison. The slide port gate 135 exists between the rotatable nozzle ring 130 and the gate ring 125. The end of the slide port gate 135 has notches 136 that engage into the ears 171 of the slide spring 170. The holes 137 in the slide port gate can sequentially align with the holes in the nozzle ring 130 and the gate ring 125 when the holes 132 and 127 are rotated into corresponding position. The motion, orientation and operation of these components is shown and described in more detail with FIGS. 5, 6 and 7. The sub assembly from FIG. 3 is shown as a complete print head unit 91 in FIG. 4 where it is placed within the ring housing 180. The ring housing has a series of holes 150 that can sequentially align with the holes in the aforementioned components.

Printing Operation Sequence

Each rotation of the print head produces potentially 14 dots spaced evenly in a line. The dots are radially arranged at 24-degree spacing; there are 15 spaces arranged around the print head. There is a port 14 of the 15 spaces. During each rotation of the print head, the paper is moved ahead by 1 dot space during the $15^{th}$ space on the print head. The print head again rotates to produce another potential of 14 dots. After 14 rotations of the print head, and array of 14 dots by 14 rows has been produced on the paper. This produces 196 dots per square-inch resolution. While a resolution of 14 dots is disclosed it is contemplated that printers with higher or lower resolution can be produced using the technology disclosed herein.

Figure 5:
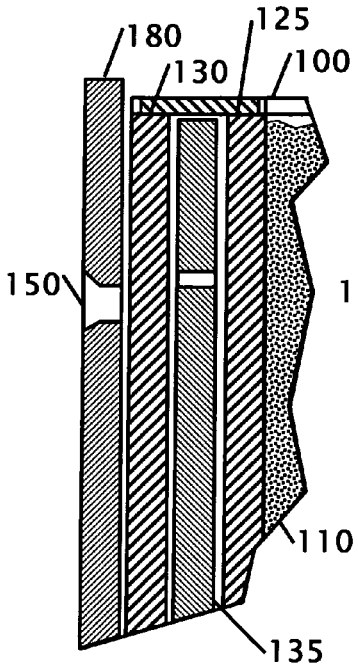
FIG. 5 shows the gate ring and the nozzle ring out of alignment with the nozzle body.
Figure 6:
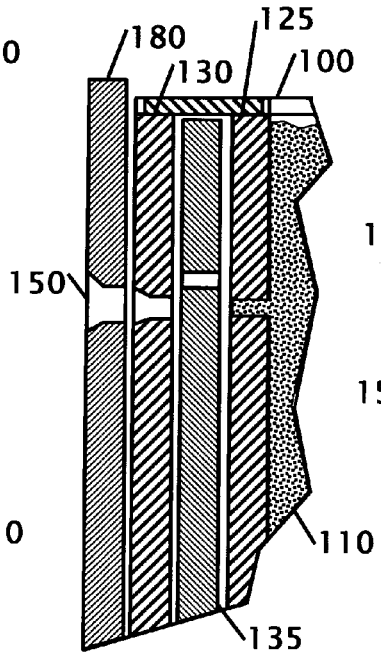
FIG. 6 shows the slide ring blocking the flow of ink.
Figure 7:
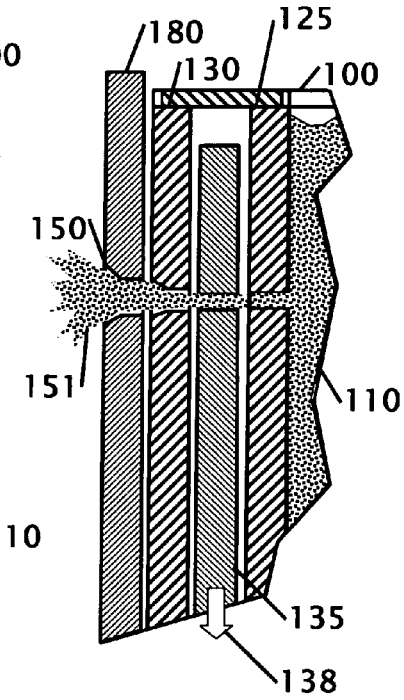
FIG. 7 shows an aligned set of windows with the ink flowing from within the printing head.

FIGS. 5, 6 and 7 show and describe printing a single dot. FIG. 5 shows the gate ring 125 and the nozzle ring 130 out of alignment with the nozzle body 180. FIG. 6 shows the gate ring 125 and the nozzle ring 130 aligned with the nozzle body 180 but the flow of ink is being blocked by the slide ring 135. FIG. 7 shows the gate ring 125, the nozzle ring 130 the nozzle body 180 and the slide ring 135 all in alignment allowing the flow of ink 151 from the ink well 110 out the nozzle 150. The nozzle ring 180 and the gate ring 125 are maintained in rotational relationship with the coupling ring 100.

Ink Delivery

The print head is essentially a hollow tube with ink pumped through it. Normally, the ink supply 110, flows under pressure, into the top of the print head and then is output through the center of the stator 120. In cases of a multiple print head assembly, the ink cascades from the output of one into the top of another. During the actual printing process, the ink flows is modified.

The nozzles 150 along the length of the print head can allow the ink to escape. There are paths through the print head that are perpendicular to the ink that is flowing through it. A non-rotating sliding valve tube normally interrupts these paths. In addition, a rotating gate tube as it rotates provides sequential and unique access to each of these paths. When the sliding tube is located as to not interrupt the paths and with the coincidence of one of the sequential paths in the rotating gate tube ink escapes through the side of the print head. This causes a short stream of ink that produces the ink dot.

Figure 8:
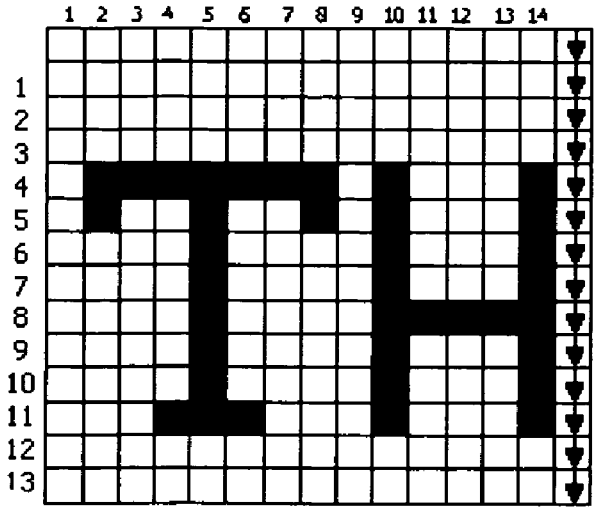
FIG. 8 is a sample of the print that is possible with the printer

The media travel is tangent to the print head. As each nozzle passes, there is an opportunity to mark the media. When the "space" passes the marking platen there is an opportunity to move the media. It is the controlled use of these "mark" and "move" opportunities that allow the different images to be created. If the media is moved a finite distance each time a space passes, the resulting marking pattern from a single head would be shown in FIG. 8.

Print Color Generation

Figure 9:
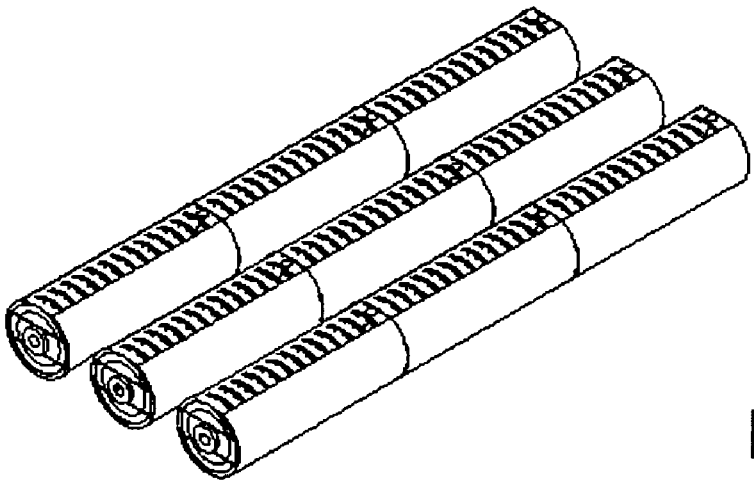
FIG. 9 shows three print heads aligned to print different colors on media.

FIG. 9 shows three print heads aligned to print different colors on media. Each print head is designed to be monochromatic. All of the dots printed are of one color. In order to produce color printing if text or graphics, there must be an arrangement of several print head assemblies. Each assembly will provide a dot of specific color; dithering or overlapping the dot can create color images. Three primary colors are used with an optional fourth black color to print virtually any color. It is further contemplated that the amount of time the slide ring is opened could be varied to alter the amount of ink that is deposited.

In another contemplated embodiment, the Rotojet print head can print on a roll of paper and the paper can be slit to make narrower rolls for use as wallpaper or a poster that is later re-assembled.

Figure 10:
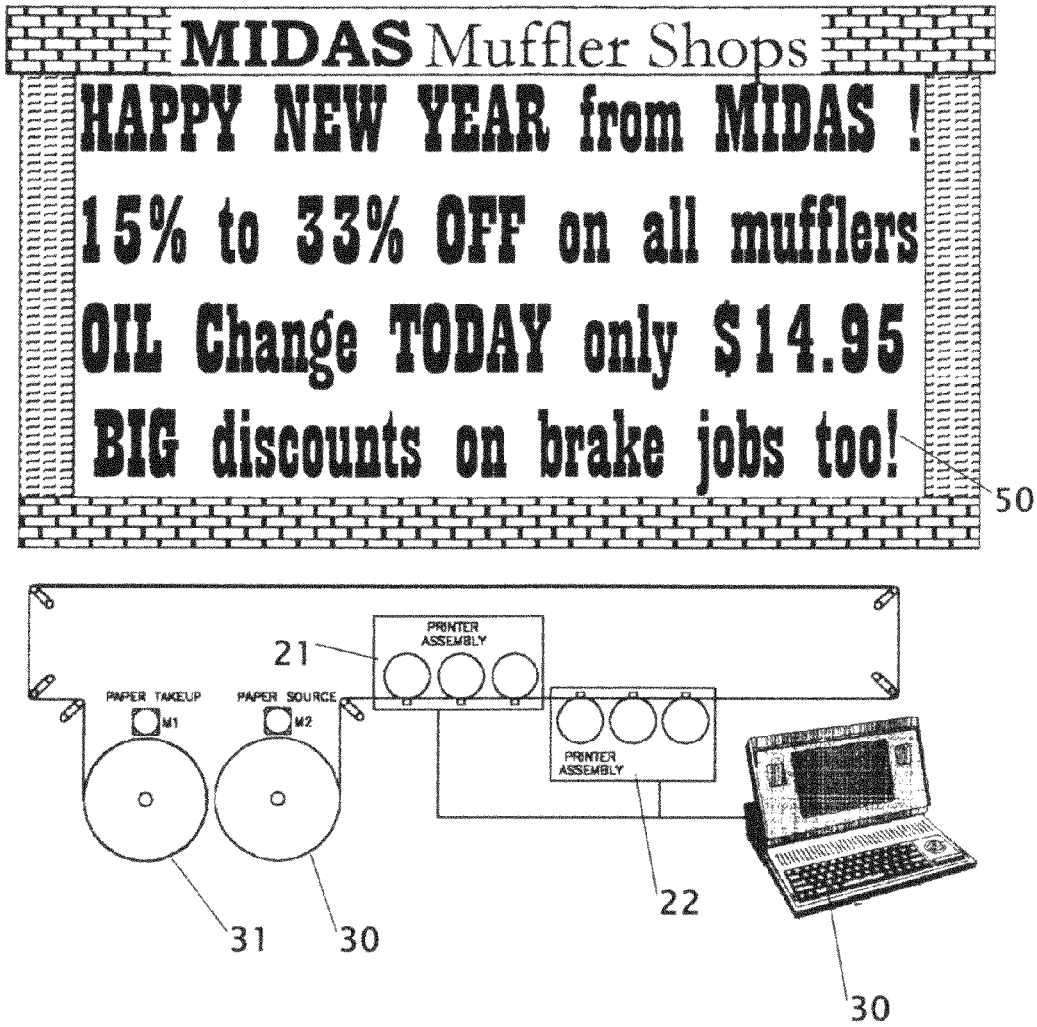
FIG. 10 shows the complete printer in an embodiment of printing a two-sided advertisement sign.

FIG. 10 shows a complete printer in an embodiment of printing a two-sided advertisement sign. This figure has a computer 30 connected to two separate three-color printers 21 and 22 where each prints on opposite side of the media. A supply reel 31 supplies paper that is printed and then collected on take-up reel 30. This configuration allows the sign 50 to have an image that can be viewed from either side of the media. In this configuration, a sign 50 is shown how it may be displayed at a business.

Thus, specific embodiments and applications for an expandable Rotojet printer have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A scalable expandable printer comprising:

an inner pressurized ink well surrounded by a rotatable gate ring having holes existing in a spiral manner around the rotatable gate ring; inside a slide ring having a plurality of holes placed in a linear relationship along one side of the slide ring wherein;

the slide ring is selectively moved by an electromagnet to align at least one hole in the slide ring with at least one hole in the gate ring whereby allowing some of the pressurized ink to pass through the aligned holes and mark media in front of the aligned holes.

2. The scalable expandable printer from claim 1 that further includes a nozzle ring that is mechanically linked to the rotatable gate ring such that they rotate in unison around the slide ring.

3. The scalable expandable printer from claim 2 that further includes a ring housing that is mechanically linked a housing frame.

4. The scalable expandable printer from claim 3 where the mechanical link is a coupling ring.

5. The scalable expandable printer from claim 1 wherein the rotatable gate ring is configured with equally spaced holes arranged in a linear relationship along the length of the gate ring.

6. The scalable expandable printer from claim 1 wherein the electromagnet comprises a coil that attracts the slide ring to align only one hole of the gate ring with one hole of the slide ring.

7. The scalable expandable printer from claim 1 wherein multiple print heads are linearly connectable to form an expandable printing array.

8. The scalable expandable printer from claim 7 wherein multiple printing arrays are used wherein each printing array prints a different color.

9. The scalable expandable printer from claim 8 wherein the colors comprise primary colors.

10. The scalable expandable printer from claim 9 that further includes black.

11. The scalable expandable printer from claim 1 wherein the media consists of paper, vinyl, cloth, plastic, or other flexible media that can be printed.

12. The scalable expandable printer from claim 1 further includes an interface for communication to a controller for control of the information to be printed.

13. The scalable expandable printer from claim 1 where printers can be placed on opposite sides of the media and the media can be printed on both sides.

14. The scalable expandable printer from claim 1 that further includes a feeding mechanism to transport the media past the marking heads.

15. The scalable expandable printer from claim 14 that further includes a take-up real to collect printed media that has been printed.

16. The scalable expandable printer from claim 1 that further includes a slitting mechanism to separate the printed media into multiple separate rolls.

17. The scalable expandable printer from claim 1 wherein the slide ring and the gate ring have equally spaced and corresponding holes.

18. The scalable expandable printer from claim 1 wherein the gate ring is sequentially rotated to one of the equally spaced and corresponding holes and further has an additional position that blocks the flow of ink from all the holes in the gate ring to allow for movement of the media.

19. The scalable expandable printer from claim 1 that further includes a driver for the electromagnet wherein the driver exists inside of the rotating printing head and uses a daisy chained connections to additional print head segments.

20. The scalable expandable printer from claim 1 that further includes software control of the electromagnet to dithering or overlapping dots of ink to create multi colored images and increase the perceived resolution.

* * * * *